US010692332B2

(12) United States Patent
Widsten et al.

(10) Patent No.: US 10,692,332 B2
(45) Date of Patent: Jun. 23, 2020

(54) REJECTION OF INVALID MEDIA

(71) Applicant: NCR Corporation, Duluth, GA (US)

(72) Inventors: Benjamin T. Widsten, Kitchener (CA); Sandeep Singh Gill, Kitchener (CA); Jason Michael Gillier, Waterloo (CA); Derek Kursikowski, Kitchener (CA)

(73) Assignee: NCR Corporation, Atlanta, GA (US)

( * ) Notice: Subject to any disclaimer, the term of this patent is extended or adjusted under 35 U.S.C. 154(b) by 0 days.

(21) Appl. No.: 15/444,225

(22) Filed: Feb. 27, 2017

(65) Prior Publication Data

US 2018/0247496 A1 Aug. 30, 2018

(51) Int. Cl.
*G07F 19/00* (2006.01)
*G07D 7/162* (2016.01)

(52) U.S. Cl.
CPC ..... *G07F 19/211* (2013.01); *G07D 7/162* (2013.01)

(58) Field of Classification Search
CPC . G06Q 20/1085; G07D 11/00; G07D 11/0021
USPC ..... 235/379, 380, 381, 383
See application file for complete search history.

(56) References Cited

U.S. PATENT DOCUMENTS 4,587,434 A 5/1986 Roes et al.
4,625,870 A * 12/1986 Nao ..... B65H 83/025 209/534
5,236,072 A 8/1993 Cargill
6,721,442 B1 4/2004 Mennie et al.
8,937,743 B1 * 1/2015 Kasuya ..... H04N 1/482 358/1.2
2012/0024659 A1 * 2/2012 Mizoro ..... G07D 11/0012 194/206
2013/0047869 A1 * 2/2013 Kataoka ..... G07D 11/0021 100/8
2014/0108244 A1 * 4/2014 Bryant ..... G07F 19/209 705/43
2014/0231214 A1 * 8/2014 Knudson ..... G07D 7/162 194/302
2015/0114794 A1 * 4/2015 Park ..... G07D 7/128 194/207
2016/0307389 A1 10/2016 Kwak et al.

FOREIGN PATENT DOCUMENTS

EP 2 077 535 A1 7/2009
WO 2007/044570 A2 4/2007

OTHER PUBLICATIONS

EP Search Report—dated Jul. 19, 2018.

* cited by examiner

*Primary Examiner* — Daniel St Cyr
(74) *Attorney, Agent, or Firm* — Schwegman, Lundberg & Woessner

(57) ABSTRACT

Systems and methods for rejecting a media object may include receiving the media object. The method may also include engaging a drive member to translate the media object. A sensor may be activated to detect an abnormality in the media object. Upon detecting the abnormality in the media object, the drive member may be engaged to reject the media object.

13 Claims, 8 Drawing Sheets

REJECTION OF INVALID MEDIA

BACKGROUND

Self-service terminals have become ubiquitous within the retail and banking environments. At the retail level, self-service terminals reduce labor requirements and increase check-out efficiency by allowing one cashier to oversee many check-out lanes. Within the financial services sector, self-service terminals, or automated teller machines, allow banking and other financial customers to make withdrawals and deposits or perform other financial transactions without having to find time to visit a financial institution during banker's hours or even visit a financial institution.

SUMMARY

Systems and methods for rejecting a media object may include receiving the media object. The method may also include engaging a drive member to translate the media object. A sensor may be activated to detect an abnormality in the media object. Upon detecting the abnormality in the media object, the drive member may be engaged to reject the media object.

BRIEF DESCRIPTION OF THE FIGURES

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the invention any manner.

DETAILED DESCRIPTION

Figure 1:
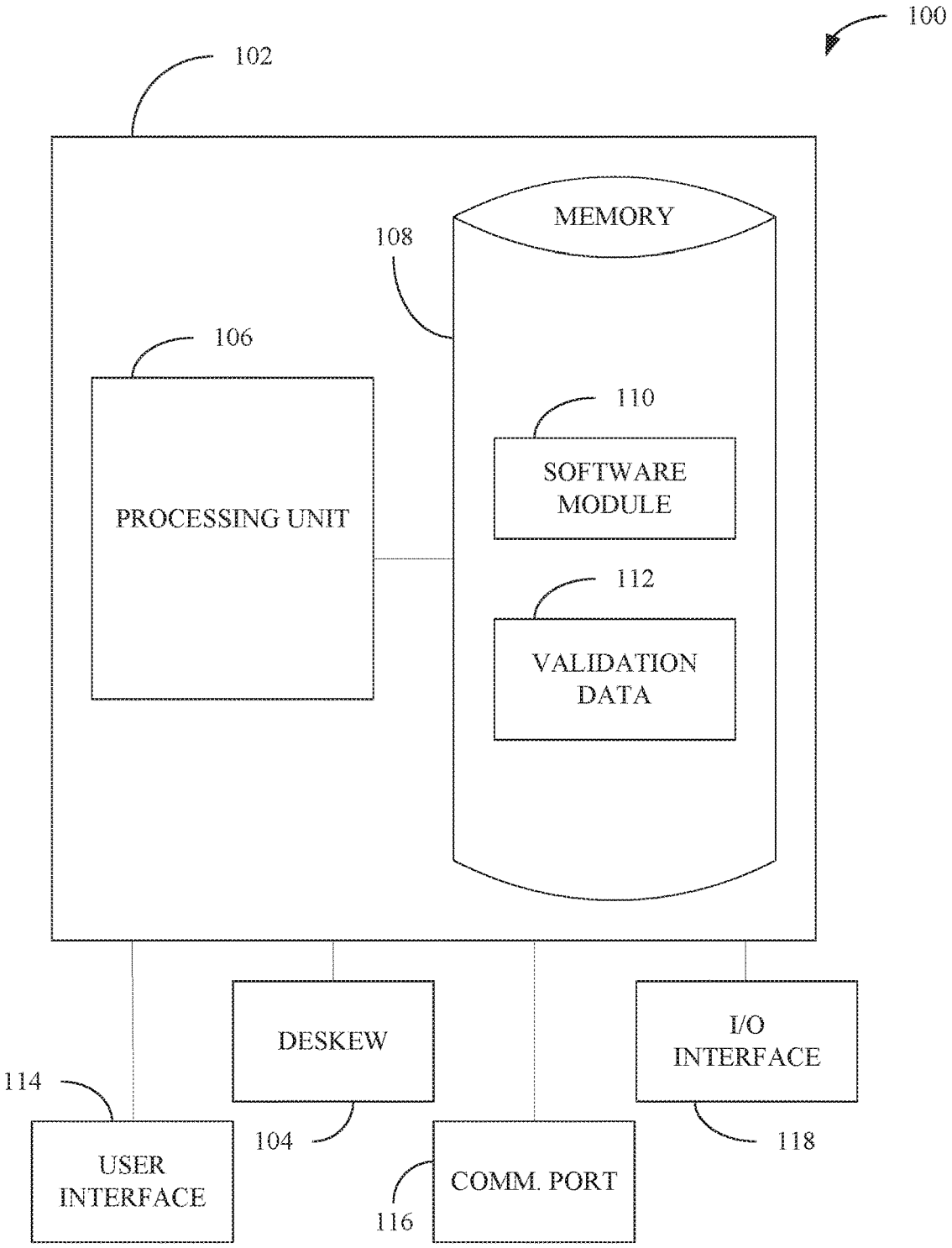
FIG. 1 shows an example schematic of a self-service terminal consistent with the disclosure.

The following detailed description refers to the accompanying drawings. Wherever possible, the same reference numbers are used in the drawings and the following description to refer to the same or similar elements. While embodiments and examples are described, modifications, adaptations, and other implementations are possible. For example, substitutions, additions, or modifications may be made to the elements and stages illustrated in the drawings, and the systems and methods described herein may be modified by substituting, reordering, or adding stages to the disclosed methods or elements to the disclosed systems. Accordingly, the following detailed description does not limit the disclosure. Instead, the proper scope of any invention disclosed herein is defined by the appended claims.

Self-service terminals may accept media objects of different sizes and conditions. For example, an automated teller machine (ATM) may accept currency having different sizes and in different states of wear. For instance, banknotes of many countries are different sizes depending on the denomination. Also, banknotes that are newer may have less damage or other signs of wear than older banknotes. Examples of a self-service terminal include, but are not limited to, an automated teller machine, a self-service checkout register, a slot machine, arcade game, and a vending machine.

As media objects (e.g., banknotes, checks, etc.) are received in a self-service terminal, the media objects may be in various orientations. For example, the media objects may be at an angle relative to a travel direction. To position the media objects into a uniform orientation, self-service terminals may use a deskew. The deskew may also include sensors as disclosed herein that may be used to validate the media object.

Validation of the media object may be needed to combat fraudulent activity occurring where irregular shaped or torn pieces of paper are being used to deliberately induce a jam. Once the jam has disabled the ATM a fraudulent claim for a lost transaction may be made. The irregular shaped or torn pieces of paper (e.g., an ATM transaction receipt), may feed into an escrow of the self-service terminal. The escrow, however, may be designed to handle regular shaped valid media and thus only has drive mechanisms oriented to handle valid media objections. Momentum may carry the torn piece of paper into the escrow, but due to the mechanical limitations of the drive mechanisms and feedback sensors it cannot be driven out. The result may be a fatal jam. A fatal jam may be any malfunction of the self-service terminal that takes the self-service terminal out of service or otherwise might require a service technician to remove the torn piece by disassemble the escrow module or the complete replacement of the escrow module. Service of this nature may be very expensive and time consuming.

As disclosed herein, sensors may be used to detect invalid media objects and to reject irregular shaped or torn pieces media to prevent them from entering the escrow. Stated another way, the sensors may be used to determine if a media object is irregularly shaped, torn, or has some other abnormality and can then eject the media object back to the user thereby keeping the media object from jamming the escrow and allowing the self-service terminal to remain in service.

As disclosed herein, irregularly shaped, torn, or otherwise abnormal media objects may be detected using sensors to determine if a media object is too narrow, too wide, too short, or too long. By determining if a media object is too narrow, too wide, too short, or too long, a determination may be made as to whether the media object might cause a jam or other malfunction of an escrow unit.

Testing a width of a media object may be done in the deskew. For example, after the media object is deskewed, sensors may monitor for a time period. If, during the time period, the sensors remain unblocked, the media object may be classified as too narrow. If all the sensors remain blocked, the media object may be classified as too wide. If some sensors remain unblocked and others remain blocked, the media object may be classified as valid in terms of its width. If the media object is classified as too narrow or too wide, the transport of the media object may be immediately stopped and the media object may be ejected back to the user. Otherwise, during the time period, if the proper sensors remained blocked and unblocked, the media object, being found to be valid based on its width, may be allowed to proceed.

Testing a length of a media object may be done as the media object enters or exits the deskew. For example, a sensor may activate as the media object passes (at a known speed) and a time at which the media object blocks the sensor may be determined. Based on the time and speed, the length of the media object may be determined. In addition, the media object may be placed in a particular location within the deskew and multiple sensors may be used determine a length of the media object in a similar fashion as determining the width of the media object. A torn or otherwise folded media object may register as being too short as disclosed herein because an irregular shaped or town piece of paper will likely measure as too short. A too short or too long criteria may be defined as an item being shorter or longer than the shortest or longest valid document in the self-service terminals' country's currency. If the item is determined to be too short or too long, the transport of the media object may be immediately stopped and the media object may be ejected back to the user. Otherwise, the media object, being found to be valid based on its length, may be allowed to proceed.

As disclosed herein validating media objects by determining their width and length has proven successful at detecting, stopping, and ejecting irregular shaped media objects. Since the irregular shaped media objects are stopped in an upper transport of the self-service terminal and prevented from entering the escrow, the successful eject rate is higher compared to previous methods of attempting to processing it through a deposit module or depository. The systems and methods disclosed herein allow the self-service terminal to prevent potential fraudulent activity by ejecting suspicious media objects and remaining in service.

Turning now to the figures, FIG. 1 shows an example schematic of a self-service terminal 100 consistent with embodiments disclosed herein. The self-service terminal 100 may include a computing environment 102 and a deskew 104. The deskew 104 may act as a media accepter/dispenser. During operation, the deskew 104 may accept media objects such as checks, banknotes, or other negotiable instruments. As discussed herein, the deskew 104 may operate in conjunction with the computing device 102 to accept media and properly orient the media.

As shown in FIG. 1, the computing device 102 may include a processor 106 and a memory unit 108. The memory unit 108 may include a software module 110 and validation data 112. While executing on the processor 106, the software module 110 and the validation data 112 may perform processes for validating a media object, including, for example, one or more stages included in method 300 described below with respect to FIG. 3.

The validation data 112 may include specifications for valid media objects. Examples of validation data 112 include, but are not limited to, a minimum and maximum length for a valid media object and a minimum and maximum width for a valid media object. The lengths and widths may be expressed as ranges of acceptable lengths and widths.

The self-service terminal 100 may also include a user interface 114. The user interface 114 may include any number of devices that allow a user to interface with the self-service terminal 100. Non-limiting examples of the user interface 114 may include a keypad, a microphone, a speaker, a display (touchscreen or otherwise), etc.

The self-service terminal 100 may also include a communications port 116. The communications port 116 may allow the self-service terminal 100 to communicate with information systems such as banking and other financial systems. Non-limiting examples of the communications port 116 may include, Ethernet cards (wireless or wired), Bluetooth® transmitters and receivers, near-field communications modules, etc.

The self-service terminal may also include an input/output (I/O) device 118. The I/O device 118 may allow the self-service terminal 100 to receive and output information. Non-limiting examples of the I/O device 118 may include, a camera (still or video), a printer, a scanner, etc.

Figure 2:
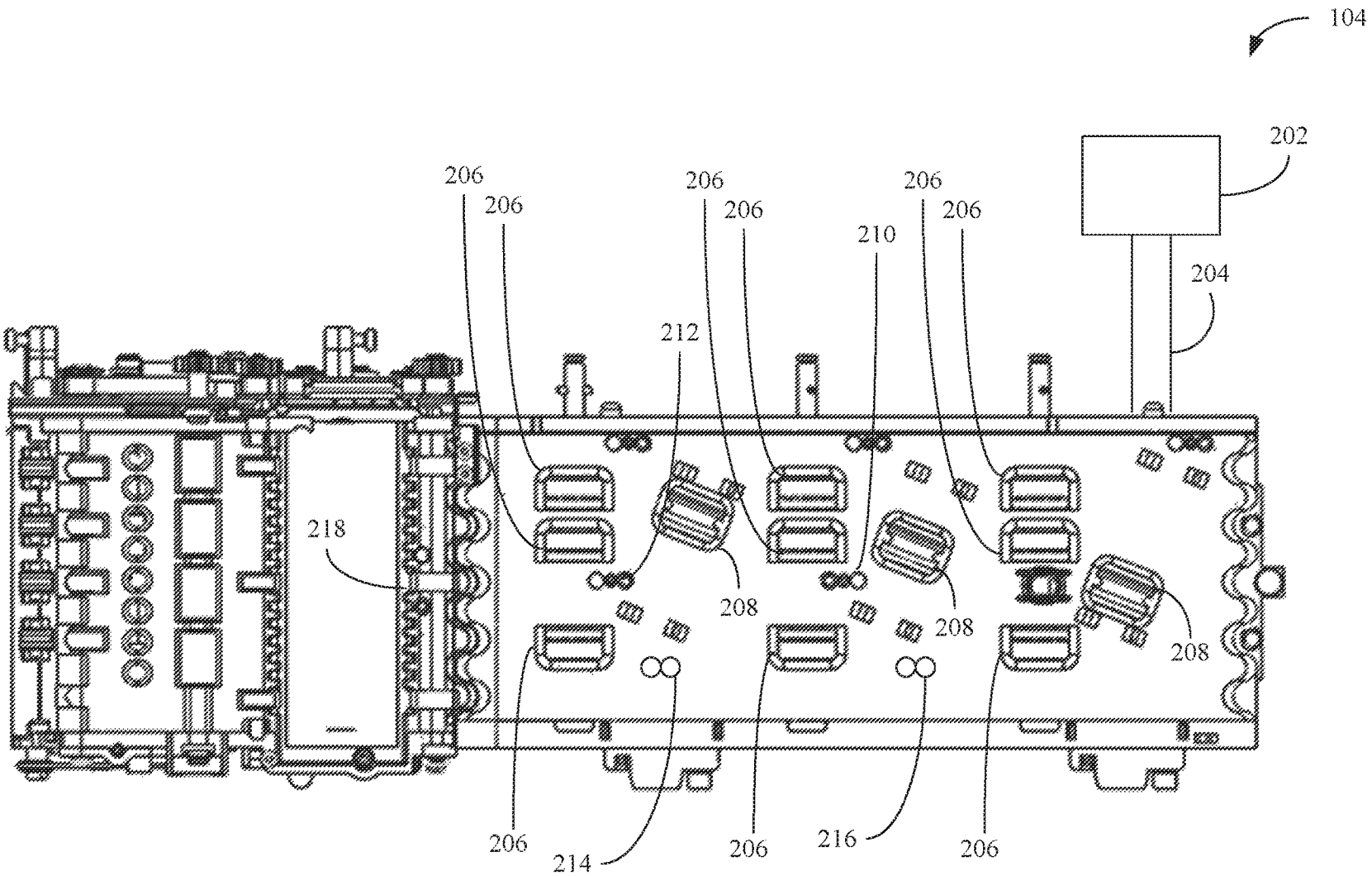
FIG. 2 shows an example deskew and consistent with the disclosure.

FIG. 2 shows an example top view of the deskew 104. The deskew 104 may include a motor 202 operably connected to a drivetrain 204. The drivetrain 204 may be operably connected to a one or more drive members 206 and deskew members 208. As discussed below with respect FIGS. 4A-5C, the drive members 206 and the deskew members 208 may be used to position a media object within the deskew 104. The deskew members 208 and the drive members 206 may include one or more rollers, belts, or other forms of conveyance that may be used to move media objects through the deskew 104.

During operations, solenoids (not shown) may be used to raise and lower the drive members 206 and the deskew members 208. For example, to move the media object in a first direction, the solenoids may lower the drive members 206 such that the drive members 206 contact a portion of the media object. To move the media object in a second direction the solenoids may raise the drive members 206 and the solenoids may lower the deskew member 208. A first sensor 210, a second sensor 212, a third sensor 214, and a fourth sensor 216 may be used to detect a width of the media object within the deskew 104. A third sensor 218 may be used separately or in conjunction with the first sensor 210, the second sensor 212, the third sensor 214, or the fourth sensor 216 to determine a length of the media object. The sensors 210, 212, 214, 216, and 218 may be optical sensors, cameras, ultrasonic sensors, lasers, etc.

Figure 3:
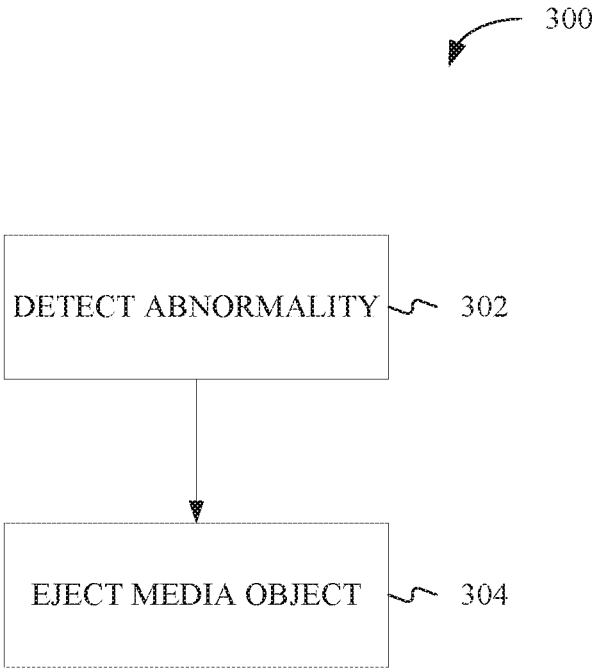
FIG. 3 shows example stages for validating a media object consistent with the disclosure.

FIG. 3 shows example stages of a method 300 for validating a media object. The method may begin at stage 302 where an abnormality in the media object may be detected. As disclosed herein, detecting the abnormality in the media object may include determining that the media object is too short, too long, too narrow, or too wide.

Figure 4A:
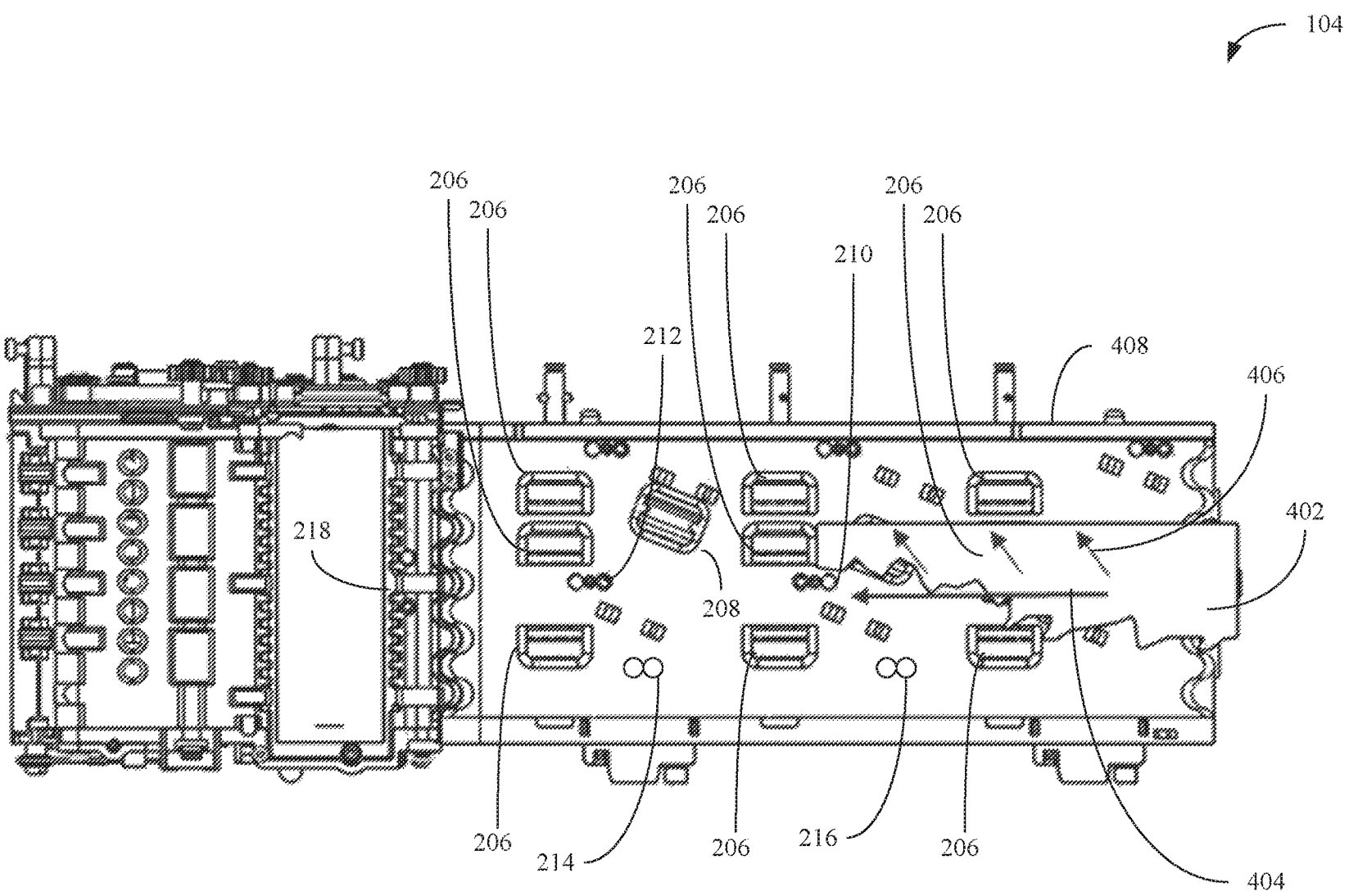
FIGS. 4A and 4B show example stages for detecting an abnormality in a media object consistent with the disclosure.
Figure 4B:
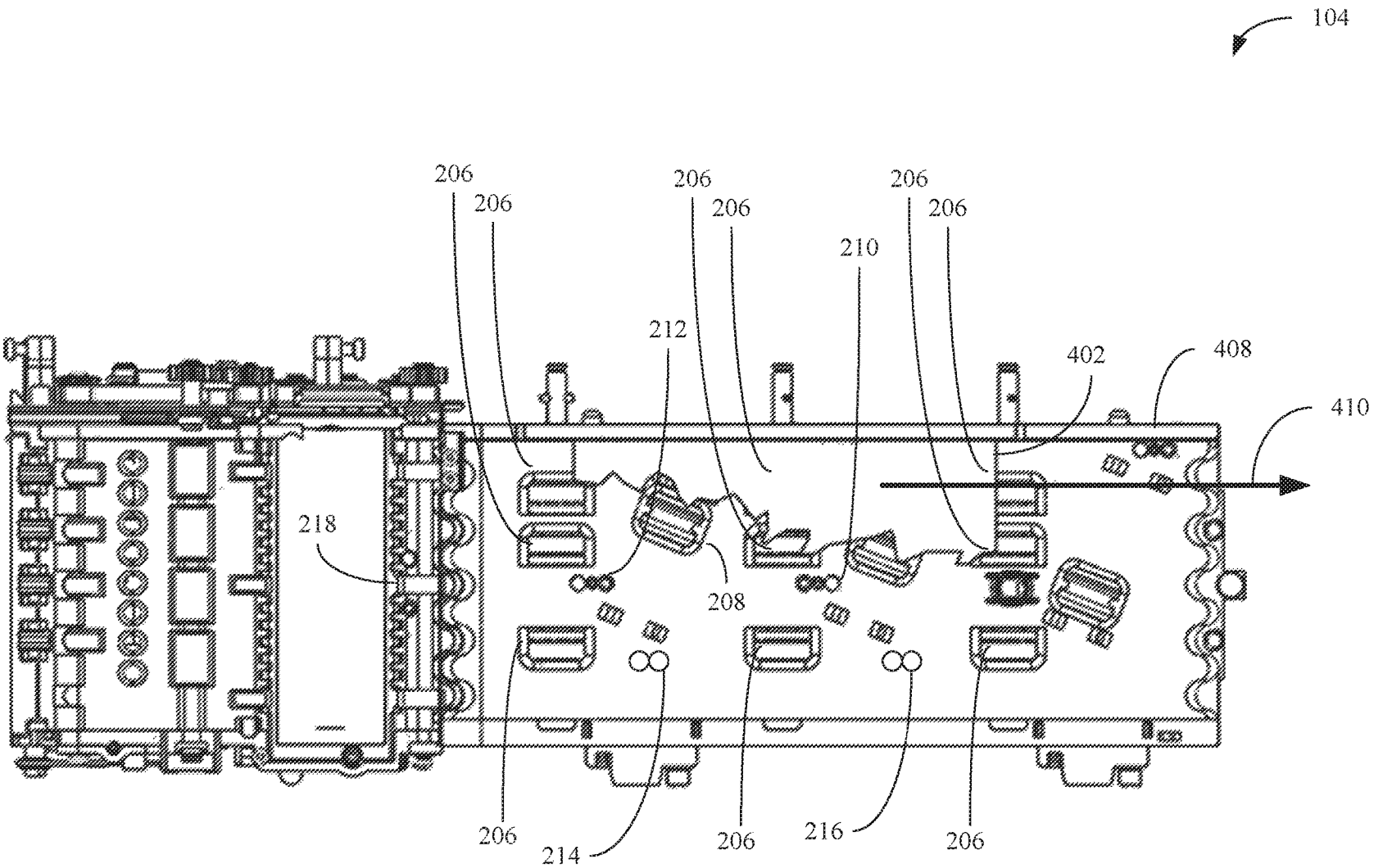

For example, and with respect to FIGS. 4A and 4B, first sensor 210 and second sensor 212 may be used to determine when a media object 402 is too wide or too narrow. As shown in FIGS. 4A and 4B, the media object 402 may be received at the deskew 104. Upon being received at the deskew 104, the drive members 206 may be activated via the motor 202. Activation of the drive members 206 may cause the media object 402 to translate within the deskew 104 as indicated by arrow 404. In addition, activation of the deskew members 208 may cause the media object 402 to translate within the deskew as indicated by arrows 406. Movement of the media object 402 by the deskew members 208 may cause the media object 402 to rest against as sidewall 408 as shown in FIG. 4B. The drive members 206 may be further activated to position the media object 402 as shown in FIG. 4B.

Once the media object 402 is in position as shown in FIG. 4B, the first sensor 210 and the second sensor 212 may be activated. Because the media object 402 does not cover the first sensor 210 and the second sensor 212, the media object 402 may be deemed to be too narrow. To determine that the media object is too wide, the third sensor 214 or the fourth sensor 216 may be covered by the media object 402. Stated another way, the distance between the first sensor 210 and the fourth sensor 216 and the second sensor 212 and the third sensor 214 may define a range of acceptable widths for the media object 402.

While two rows of sensors are shown in the figures, any number of rows may be utilized to define a range or ranges for acceptable widths of the media object 402. In addition, different sensors may be activated depending on the type of media object expected by the self-service terminal 100. For example, if a user is attempting to deposit cash, a first set of sensors may be active because a width of the banknote is known. If the user is attempting to deposit a check, then a different set of sensors may be activated (or in addition to the first set of sensors) because a width of a standard check may be known.

If the media object 402 is found to be too narrow or too wide, the drive members 206 may be activated to translate the media object 402 is indicated by arrow 410. In other words, if the media object 402 is found to be too narrow or too wide, the media object 402 may be ejected from the deskew 104 in stage 304 of the method 300.

Figure 5A:
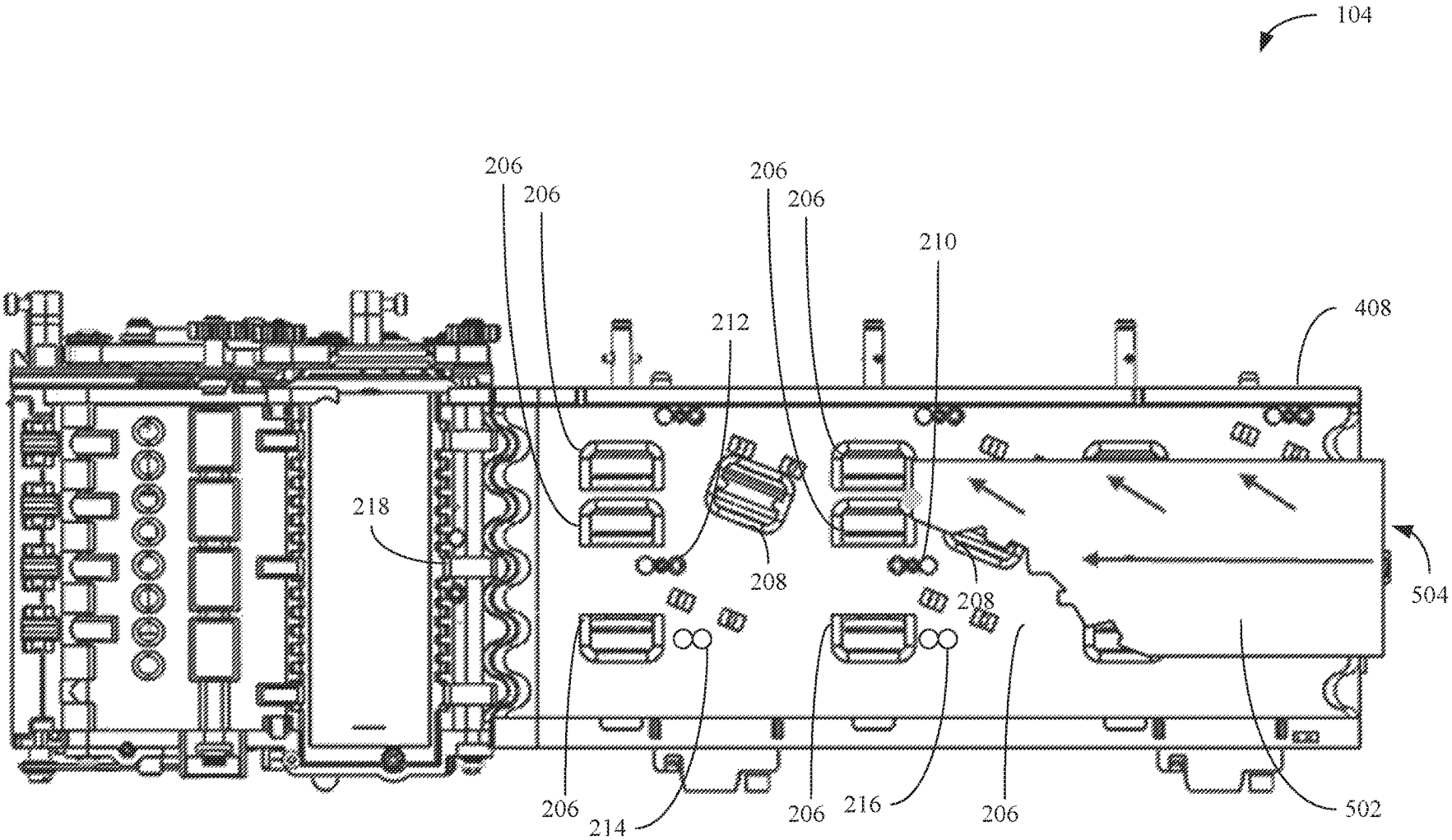
FIGS. 5A, 5B, and 5C show example stages for detecting an abnormality in a media object consistent with the disclosure.
Figure 5B:
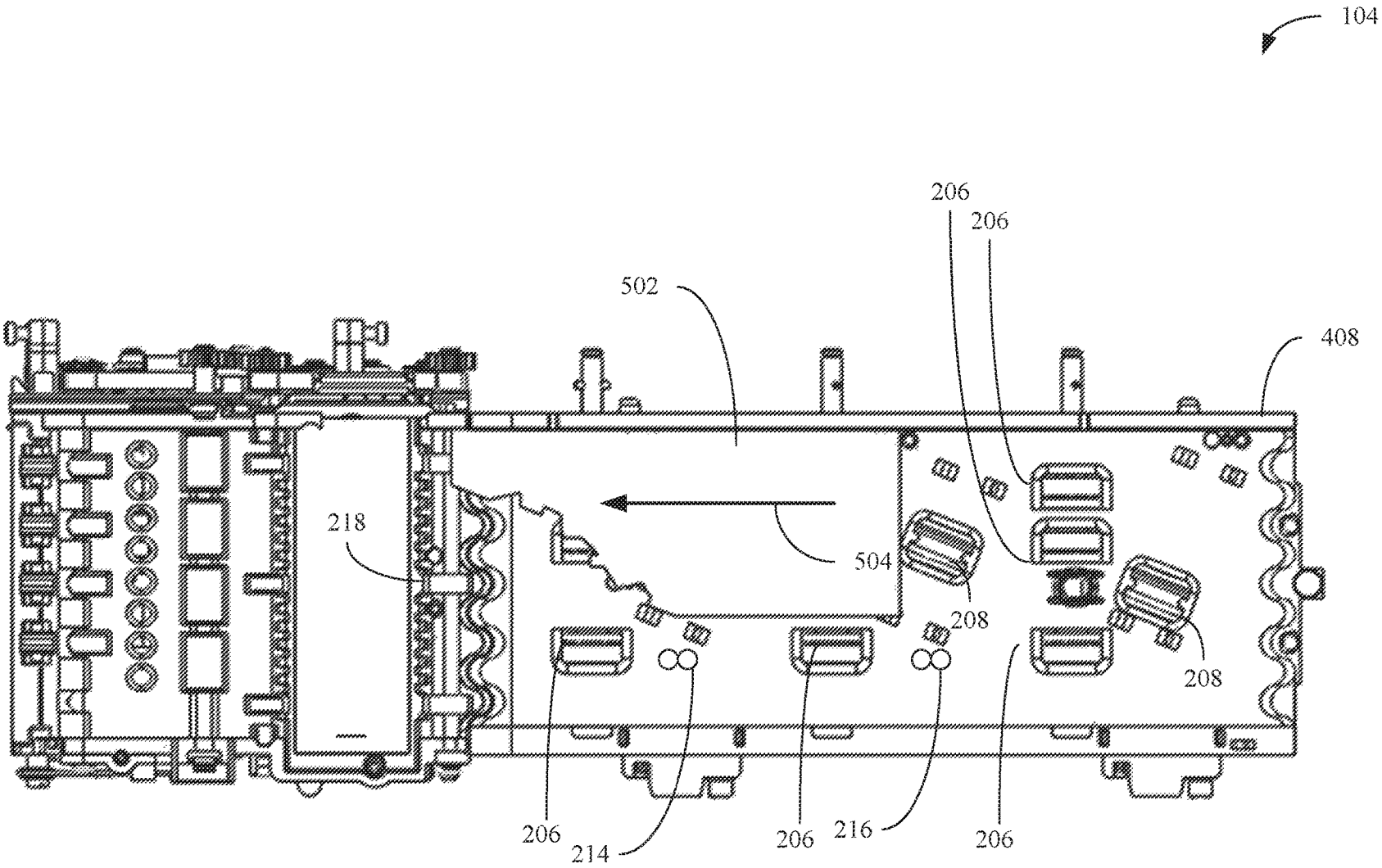
Figure 5C:
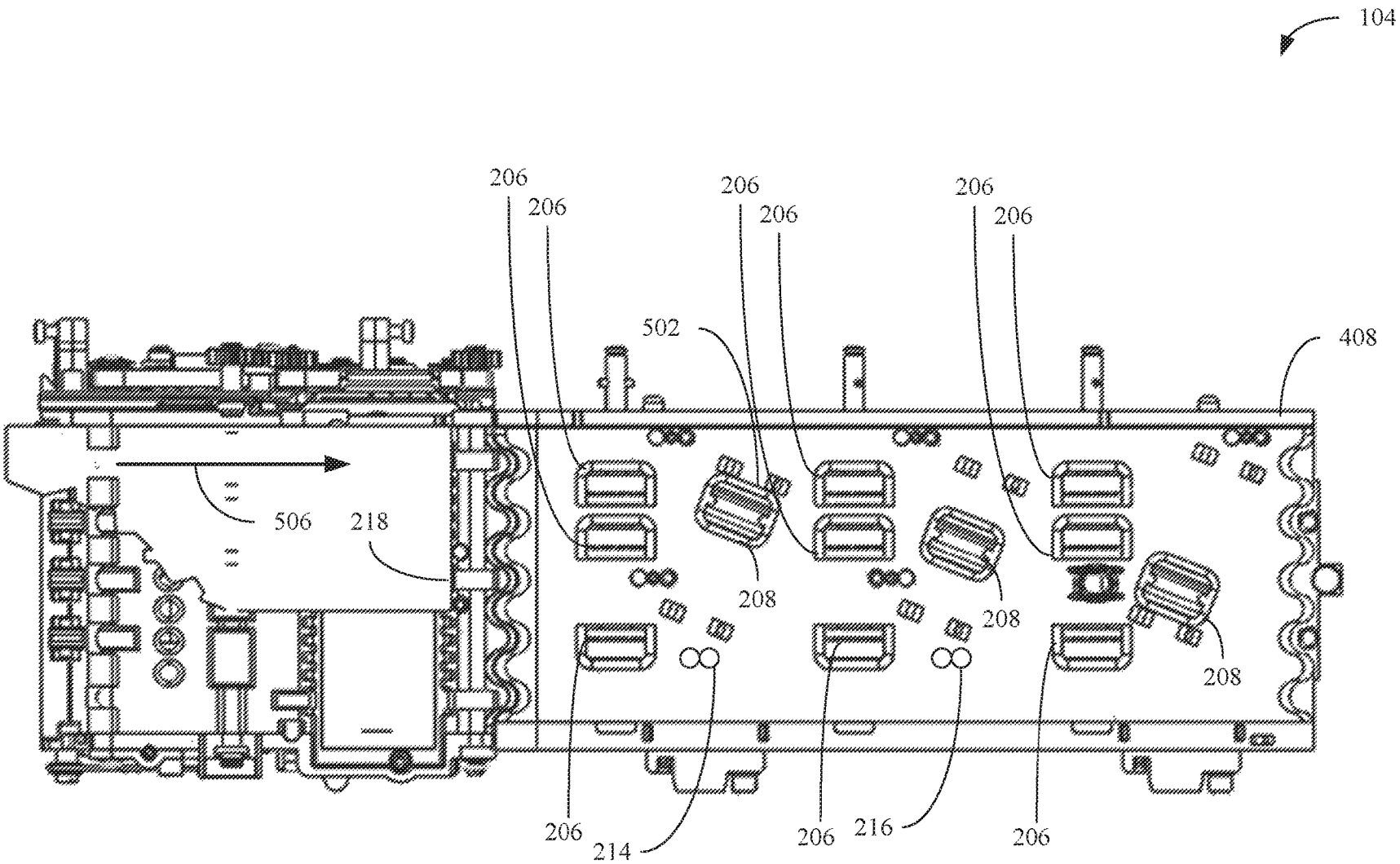

FIGS. 5A, 5B, and 5C show example stages for determining that a media object 502 is too long or too short. As shown in FIGS. 5A, 5B, and 5C, the media object 502 may be received at the deskew 104. Upon being received at the deskew 104, the drive members 206 may be activated via the motor 202. Activation of the drive members 206 may cause the media object 402 to translate within the deskew 104 as indicated by arrow 504. In addition, activation of the deskew members 208 may cause the media object 402 to translate within the deskew as indicated by arrows 406. Movement of the media object 402 by the deskew members 208 may cause the media object 402 to rest against as sidewall 408 as shown in FIG. 5B. The drive members 206 may be further activated to translate the media object 402 across the sensor 218 as shown in FIG. 5B.

As the media object 502 passes over the sensor 218, a time in which the media object 502 covers the sensor 218 may be recorded. The speed at which the media object 502 travels is known. Thus, the length of the media object 502 can be determined using the speed and time. In addition, the media object 502 can be translated for a given time and the amount of coverage of the sensor 218 can be determined. The amount of coverage may or may not coincide with a range of coverage that may define acceptable lengths for a valid media object.

In addition, the media object 502 can be positioned in between any two or more sensors to determine a length of the media object 502. For example, the media object 502 can be translated until it blocs sensor 218. If the media object 502 blocks sensor 210 then the media object 502 can be deemed to be too long. If the media object does not block sensor 212 then the media object 502 can be deemed to be too short. Thus, the various sensors in the deskew 104 can be used to define a range of lengths for valid media objects.

If the media object 502 is found to be too short or too long, the drive members 206 may be activated to translate the media object 502 is indicated by arrow 506. In other words, if the media object 502 is found to be too short to too long, the media object 502 may be ejected from the deskew 104 in stage 304 of the method 300.

While executing the method 300 the media object may be tested for being too narrow, being too wide, or both. In addition, the media object can be tested for being too long, too short, or both. Furthermore, the media objects, length, width, or both can be tested.

During executing of the method 300 signals may be transmitted from the sensors 210, 212, 214, 216, and 218 to the processing unit 106. In addition, the processing unit 106 may be retrieve validation data 112. For example, during the execution of the method 300 the processing unit 106 may retrieve banknote data corresponding to acceptable lengths and widths of banknotes. In addition, the processing unit 106 may receive signals from one or more of the sensors 210, 212, 214, 216, and 218. The processing unit 106 may utilize this data along with other data received by the processing unit 106 (either from other sensors, the memory 108, or calculated by the processing unit 106) to validate the media object as disclosed herein.

The systems and methods disclosed herein improve the functionality of a self-service terminal. For example, using the systems and methods disclosed herein, the self-service terminal may be able to self-diagnose a situation where a media object may jam within the self-service terminal or otherwise cause a malfunction to occur. By being able to self-diagnose situations as potentially harmful, the self-service terminal may be able to remain in service longer or otherwise avoid downtime due to jams and malfunctions.

It will be readily understood to those skilled in the art that various other changes in the details, material, and arrangements of the parts and method stages which have been described and illustrated in order to explain the nature of the inventive subject matter may be made without departing from the principles and scope of the inventive subject matter as expressed in the subjoined claims.

What is claimed is:

1. A method of rejecting a media object from a self-service terminal, the method comprising:

receiving an indication of a type of media object, the indication of the type of media object associated with expected dimensions for the media object, the expected dimensions of the media object known before the media object enters the self-service terminal;

deskewing the media object so as to cause the media object to rest against a sidewall of a deskew;

after deskewing the media object, activating, based upon the expected dimensions, a sensor for a predetermined time period within the self-service terminal to detect an abnormality in the media object, wherein the abnormality comprises the media object being too narrow when the sensor remains unblocked for the predetermined time period, and the abnormality comprises the media object being too wide when the sensor remains blocked for the predetermined time period; and ejecting the media object from a self-service terminal upon detecting the abnormality in the media object.

2. The method of claim 1, further comprising engaging a drive member to translate the media object simultaneously with activating the sensor.

3. The method of claim 1, further comprising receiving the media object in a deskew of the self-service terminal.

4. The method of claim 1, wherein the abnormality includes the media object having a length less than a standard length.

5. The method of claim 1, wherein the abnormality includes the media object having a length outside a length range.

6. A system comprising:

a media acceptor;

a processor; and a memory storing instructions that, when executed by the processor, cause the processor to perform operations comprising:

receiving, from a user, an indication of a type of media object, the indication of the type of media object associated with expected dimensions for a media object, the expected dimensions of the media object known before the media object enters the media acceptor, determining a sensor of the media acceptor to monitor based upon the expected dimensions of the media object, engaging a motor coupled to a drive member to deskew the media object so as to cause the media object to rest against a sidewall within the media acceptor, after deskewing the media object, activating the sensor to detect an abnormality in the medial object, wherein the abnormality comprises the media object being too narrow when the sensor remains unblocked for the predetermined time period, and the abnormality comprises the media object being too wide when the sensor remains blocked for the predetermined time period, receiving, from the sensor, a signal indicating the abnormality in the media object, and engaging the motor to reject the media object from the media acceptor upon detecting the abnormality in the media object.

7. The system of claim 6, wherein the abnormality includes the media object having a length less than a standard length.

8. The system of claim 6, wherein the abnormality includes the media object having a length outside a length range.

9. The system of claim 6, wherein the system is a component of any one of an automated teller machine, a self-service terminal, a slot machine, or a vending machine.

10. A media depository comprising:

a motor;

a drive member operably coupled to the motor, the drive member further operable to translate a media object through a portion of the media depository and deskew the media object so as to cause the media object to rest against a sidewall of the media depository; and a plurality of sensors located proximate the drive member and operable, based upon expected dimensions of the media object, to detect an abnormality in the media object after the media object has been deskewed, wherein the abnormality comprises the media object being too narrow when the sensor remains unblocked for the predetermined time period, and the abnormality comprises the media object being too wide when the sensor remains blocked for the predetermined time period, wherein the drive member is further operable to reject the media object upon detection of the abnormality.

11. The media depository of claim 10, wherein detection of the abnormality in the media object includes detecting the media object has a length that is less than a standard length.

12. The media depository of claim 10, wherein detection of the abnormality in the media object includes detecting the media object has a length that is outside a length range.

13. The media depository of claim 10, wherein the media depository is a component of one an automated teller machine, a self-service terminal, a slot machine, or a vending machine.

* * * * *